United States Patent [19]

Kuehler

[11] 4,264,430

[45] Apr. 28, 1981

[54] THREE-STAGE COAL LIQUEFACTION PROCESS

[75] Inventor: Christopher W. Kuehler, Larkspur, Calif.

[73] Assignee: Chevron Research Company, San Francisco, Calif.

[21] Appl. No.: 87,351

[22] Filed: Oct. 22, 1979

[51] Int. Cl.[3] ..... C01G 1/06

[52] U.S. Cl. ..... 208/10

[58] Field of Search ..... 208/10

[56] References Cited

U.S. PATENT DOCUMENTS

| | | | |
|---|---|---|---|
| 3,018,242 | 1/1962 | Gorin | 208/10 X |
| 3,852,182 | 12/1974 | Sze et al. | 208/10 X |
| 4,152,244 | 5/1979 | Raichle et al. | 208/10 X |

*Primary Examiner*—Delbert E. Gantz
*Assistant Examiner*—William G. Wright
*Attorney, Agent, or Firm*—D. A. Newell; R. H. Evans; A. H. Uzzell

[57] ABSTRACT

Disclosed is a three-stage process for liquefying coal. In the process subdivided coal is slurried with a hydrogen-lean hydrogen-donor solvent and passed through a dissolving zone at a temperature in the range 400°-480° C. and at a space velocity in the range 2-150 hr.$^{-1}$ to substantially dissolve said coal. The effluent from the dissolver is stabilized with a hydrogen-rich hydrogen-donor solvent in a stabilization zone at a temperature in the range of 400°-440° C. and at a space velocity in the range 1-12 hr.$^{31\ 1}$ to partially hydrogenate the dissolved coal. A portion of the effluent from the stabilizer is recycled for use as hydrogen-lean hydrogen-donor solvent and the remainder is passed to a catalytic reaction stage operating under hydrocracking conditions to produce the net product and hydrogen-rich hydrogen-donor solvent.

10 Claims, 1 Drawing Figure

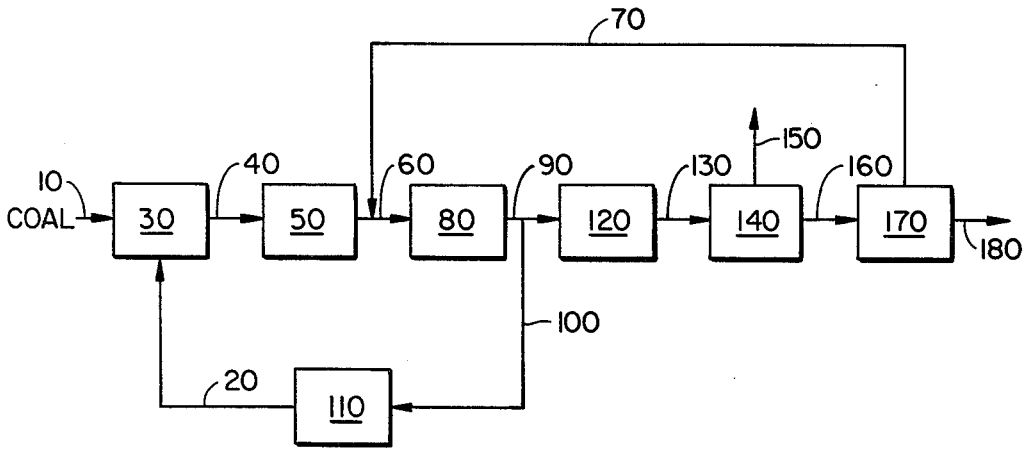
70
10
COAL
30
40
50
60
80
90
120
130
140
150
160
170
180
100
20
110

THREE-STAGE COAL LIQUEFACTION PROCESS

BACKGROUND OF THE INVENTION

1. Field of the Invention

The present invention relates to an improved process for the liquefaction of raw coal. More particularly, the invention relates to a three-stage process wherein solvents, having differing quantities of donatable hydrogen, are used to minimize gas yields and hydrogen consumption.

2. Prior Art

Coal is our most abundant indigenous fossil fuel resource, and as a result of dwindling petroleum reserves, concerted research efforts are being directed toward recovery of liquid hydrocarbons from coal on a commercial scale. A promising approach in this field is the direct liquefaction of coal.

This approach has principally evolved from the early work of F. Bergius, who discovered that transportation fuels could be produced by the high pressure hydrogenation of a paste of coal, solvent and catalyst.

Later discoveries revealed the advantage of using specific hydrogenation solvents at lower temperatures and pressures. With these solvents, such as partially saturated polycyclic aromatics, hydrogen transfer to the coal is facilitated and dissolution enhanced. However, the products from single-stage dissolvers are typically high in asphaltenes, have high average molecular weights and high viscosities. These qualities present considerable obstacles in removing the fine coal residue particles suspended in the product which usually range from 1 to 25 microns in diameter.

The complete nature of the coal residue or undissolved solids is not fully understood, but the residue appears to be a composite of organic and inorganic species. The residue organic matter is similar to coke and the inorganic matter is similar to the well known coal-ash constituents. The removal of these particles is, of course, necessary to produce a clean-burning, low-ash fuel.

Direct two-stage coal liquefaction processing evolved by the addition of a catalytic stage to further hydrogenate and break down the higher molecular weight products produced in the dissolver. In retrospect, and with the clarity hindsight often provides, such a step does not seem unprecedented. However, the direct passage of a solids-laden stream through a catalytic reactor was theretofor considered impractical at best. The two-stage units solved most of the coal residue removal problems since the hydrocracked product was relatively light and of relatively low viscosity, thereby permitting the use of conventional solids removal techniques and the asphaltene content of the product from the catalytic reactor was drastically reduced by the catalytically induced hydrogenation. Representative patents covering staged coal liquefaction processes include U.S. Pat. No. 4,018,663 issued to C. Karr, Jr. et al, U.S. Pat. No. 4,083,769 issued to R. Hildebrand et al and U.S. Pat. No. 4,111,788 issued to M. Chervenak et al.

U.S. Pat. No. 4,018,663 discloses a two-stage process in which a coal-oil slurry is passed through a first reactor containing a charge of porous, non-catalytic contact material in the presence of hydrogen at a pressure of 1,000 to 2,000 psig and a temperature of 400° to 450° C. The effluent from this reactor is then preferably filtered to remove the coal residue and passed to a catalytic reactor for desulfurization, denitrification and hydrogenation of the dissolved coal.

U.S. Pat. No. 4,083,769 discloses a process wherein a preheated coal-solvent slurry is passed with hydrogen through a first dissolver zone operated at a pressure in excess of 210 atmospheres and at a higher temperature than the preheater. The dissolver effluent is then hydrogenated in a catalytic zone also maintained at a pressure in excess of 210 atmospheres and at a temperature in the range of 370° to 440° C. to produce liquid hydrocarbons and a recycle solvent.

U.S. Pat. No. 4,111,788 discloses a process wherein a coal-oil slurry is passed through a dissolver containing no catalyst and the effluent therefrom is subsequently treated in a catalytic ebullated bed at a temperature at least 14° C. lower than the temperature of the dissolver. A portion of the product liquid is preferably recycled for use as solvent.

In each of the above processes, the coal is dissolved at high temperatures in the presence of hydrogen and/or a hydrogen donor solvent. While the physical coal dissolution requires such temperatures, the residence times required for hydrogen transfer, coupled with the high temperatures, increase the overall gas yields at the expense of liquid product and increase hydrogen consumption.

It is therefore an object of this invention to provide a coal liquefaction process which maximizes the liquid product yields without sacrificing product quality.

SUMMARY OF THE INVENTION

The present invention provides a process for liquefying coal to produce normally liquid clean hydrocarbons accompanied by a minimum gas yield and minimized hydrogen consumption. In the process, a coal-solvent slurry is prepared by mixing particulate coal with a relatively hydrogen-lean hydrogen-donor solvent. The slurry is passed through a dissolving zone which is free of externally-supplied catalyst or contact materials at a temperature in the range of 400°-480° C. and at a slurry space velocity in the range of 2-150 hrs.$^{-1}$ to substantially dissolve said coal. The effluent from said dissolver is mixed with a relatively hydrogen-rich hydrogen-donor solvent and passed through a stabilization stage at a lower temperature in the range of 370°-440° C. and at a liquid space velocity in the range of 1-12 hrs.$^{-1}$ to partially hydrogenate the dissolved coal. A portion of the effluent from the stabilizer is separated and recycled for use as a lean hydrogen-donor solvent. The remainder of the effluent from the stabilization stage is passed through a catalytic reaction stage containing hydrocracking catalyst and operating under hydrocracking conditions, including a hydrogen partial pressure in the range of 70 to 700 atmospheres, a temperature in the range of 345°-425° C., and a slurry hourly space velocity in the range 0.1 to 2 hrs.$^{-1}$. A portion of the effluent from the catalytic reaction stage is separated and recycled for use as the rich hydrogen-donor solvent.

Preferably, the dissolver and stabilizer are free of externally-supplied catalyst and contact materials. However, baffles may be used to provide plug flow conditions so that the unit may be operated on a continuous basis.

At least a portion of the coal residue in the lean hydrogen-donor solvent and/or the rich hydrogen-donor solvent may be removed prior to recycle to prevent solids build up within the unit. It is preferred that the dissolver stage be operated in the absence of hydrogen and that any gases produced be removed prior to the stabilizer; however, hydrogen or recycle gas containing hydrogen may be added to the stabilizer and, if so, a hydrogen partial pressure in the range of 70 to 700 atmospheres should be maintained.

Preferably, the slurry space velocity in the first dissolving stage is kept high and in the range of 12–120 hr.$^{-1}$.

BRIEF DESCRIPTION OF THE DRAWING

The drawing illustrates suitable block form flow paths for practicing one embodiment of the present invention.

Particulate coal and lean hydrogen-donor solvent are blended in zone 30 to form a pumpable coal-solvent slurry. The slurry passes to a dissolving stage 50 wherein the coal is substantially dissolved at an elevated temperature. Effluent from the dissolver is mixed with a rich hydrogen-donor solvent and passed through a stabilizer 80 to partially hydrogenate and stabilize the dissolved coal, preferably at a lower temperature. A portion of the partially hydrogenated effluent is recycled through line 100 and solids removal zone 110 to the mixing zone 30 for use as lean hydrogen-donor solvent. The remainder of the effluent 90 passes through catalytic reaction zone 120 to provide a product and a rich hydrogen-donor solvent. Effluent from the reaction zone passes through a gas liquid separator 140 where the light gases and oils are flashed off and the remaining liquid is passed through a solids separation zone 170. A portion of the liquid product is recycled via line 70 as rich hydrogen-donor solvent and the remainder is taken as product.

DETAILED DESCRIPTION OF THE PREFERRED EMBODIMENTS

Referring to the drawing in detail, subdivided coal 10 and a lean hydrogen-donor solvent 20 are mixed in zone 30 to form a pumpable slurry. The basic feedstock of the present invention is a solid particulate coal such as anthracite, bituminous coal, sub-bituminous coal, lignite, or mixtures thereof. The bituminous and sub-bituminous coals are particularly preferred, and it is also preferred that said coals be comminuted or ground to a particle size smaller than 100 mesh, Tyler standard sieve size, although larger coal sizes may be processed. The solvent used in zone 30 is a lean hydrogen-donor solvent which is processed-derived.

Hydrogen-donor solvents are known in the art and comprise polycyclic aromatic hydrocarbons such as tetrahydronaphthalene or dihydronaphthalenes, which are capable of being at least partially saturated. After hydrogenation, these solvents can donate or transfer the acquired hydrogen to hydrogen-deficient dissolved coal molecules. As used herein, the term "lean" hydrogen-donor solvent refers to a hydrogen-donor solvent which is substantially depleted of donatable hydrogen at the pertinent process conditions and is therefore substantially inadequate for further hydrogen transfer. With such lean hydrogen-donor solvents, chemical interaction or hydrogen transfer between solvent and coal is minimal, although the solvent still possesses physical solvation properties. Conversely, the term "rich" hydrogen-donor solvent refers to a hydrogen-donor solvent which has been at least partially hydrogenated and is therefore capable of donating hydrogen to the dissolved coal at the process conditions in addition to possessing physical solvation properties. Generally a "lean" hydrogen-donor solvent will have a hydrogen to carbon molecular ratio of less than 1.2 and conversely a "rich" hydrogen-donor solvent will have a hydrogen to carbon molecular ratio of greater than 1.2.

The subdivided coal is mixed or blended with a lean hydrogen-donor solvent in a solvent to coal weight ratio from about 1:1 to 3:1, preferably from about 1:1 to 2:1.

The slurry from zone 30 is heated by conventional means (not shown) such as process heat exchangers, steam coils or fired heaters, and passed via line 40 to dissolving zone 50. Dissolving zone 50 basically comprises an elongated vessel free of external catalyst or contact materials which provides sufficient residence time for the coal to dissolve or break up under the process conditions. The dissolver is operated at a temperature in the range of about 400°–480° C., and preferably 425°–455° C., and at a pressure of about 1 to about 200 atmospheres. A slurry hourly space velocity is maintained in the dissolver of about 2–150 hours$^{-1}$ and more preferably about 12–120 hours$^{-1}$. Since the present invention separates the initial coal break-up from the dissolved coal hydrogenation steps, it is possible to operate the dissolver at the higher temperatures required for dissolution of the coal for a much shorter residence time than is used in the two-stage systems of the prior art. Operating the dissolver at a short residence time in the absence of hydrogen or a rich hydrogen-donor solvent minimizes the hydrogen consumption and the light gas make and thereby increases the coal-liquid yields.

Process-derived rich hydrogen-donor solvent 70 is blended with the effluent 60 from the dissolver and the mixture is passed through a stabilization zone 80. The weight ratio of rich hydrogen-donor solvent to the first-stage effluent should be in the range 0.25 to 2 and preferably 0.5 to 1.

The function of the stabilization zone lies primarily in partially hydrogenating and stabilizing the effluent from the dissolver with hydrogen donated from the rich hydrogen-donor solvent. Preferably, hydrogen or recycle gas effluent from the downstream catalytic stage, which is comprised substantially of hydrogen, is also added to the stabilizer to aid in hydrogenation. Since the coal is dissolved in the first stage, the stabilizer may be operated at a lower temperature. Preferably, the stabilizer is maintained at a temperature in the range of 370°–440° C., and more preferably at a temperature in the range of 400°–425° C. The stabilizer, like the dissolver, is basically an elongated vessel having no externally-added catalyst or contact materials; however, the coal residue or minerals may exert some catalytic effect.

Preferably, a pressure of 35 to 680 atmospheres and more preferably 70 to 205 atmospheres should be maintained in the stabilizer. A hydrogen gas rate of 178 to 1780 standard cubic meters per meter of slurry and preferably 500 to 900 standard cubic meters per meter of slurry should be maintained if hydrogen is added. A liquid hourly space velocity in the range of 1 to 12 hours$^{-1}$ is normally sufficient to achieve the desired partial hydrogenation of the dissolved coal.

The effluent 90 from the stabilizer comprises partially hydrogenated dissolved coal, coal residue and lean hydrogen-donor solvent. A portion 100 of this effluent is separated by conventional means (not shown) for use as lean hydrogen-donor solvent in mixing zone 30. Preferably, said lean hydrogen-donor solvent comprises a 200° C.+ boiling fraction and is passed through a solids removal zone 110 wherein a substantial portion of the coal residue may be removed prior to the mixing zone. The solids removal zone 110 may be of conventional design such as gravity settlers, hydroclones, filters, cokers or the like.

The remainder of the effluent, containing dissolved coal, solvent and insoluble solids or coal residue from the stabilizer passes through catalytic reaction zone 120 containing hydrocracking catalyst. In the hydrocracking zone, hydrogenation and cracking occur simultaneously, and the higher molecular weight compounds are further hydrogenated and converted to lower molecular weight compounds. The sulfur from sulfur-containing compounds is converted to hydrogen sulfide, the nitrogen to ammonia, and the oxygen to water. Preferably, the catalytic reaction zone is a fixed bed type, although an ebullating or moving bed may be used. The mixture of gases, liquids and insoluble solids preferably passes upwardly through the catalytic reactor but may also pass downwardly.

The catalysts used in the hydrocracking zone may be any of the well known and commercially available hydrocracking catalysts. A suitable catalyst for use in the hydrocracking zone comprises a hydrogenation component and a mild cracking component. Preferably the hydrogenation component is supported on a refractory, weakly acidic, cracking base. Suitable bases include, for example, silica, alumina, or composites of two or more refractory oxides such as silica-alumina, silica-magnesia, silica-zirconia, alumina-boria, silica-titania, silica-zirconia-titania, acid-treated clays and the like. Acidic metal phosphates such as alumina phosphate may also be used. Preferred cracking bases comprise alumina and composites of silica and alumina. Suitable hydrogenation components are selected from Group VIb metals, Group VIII metals, and their oxides, sulfides or mixtures thereof. Particularly preferred are cobalt-molybdenum, nickel-molybdenum or nickel-tungsten on alumina supports.

The temperature in the hydrocracking zone should be maintained below 430° C. and more preferably in the range of 340° C. to 400° C. to prevent fouling. The temperature in the hydrocracking zone should thus be maintained below the temperature in the stabilization zone and may be accomplished by cooling the stabilizer effluent by conventional methods such as indirect heat exchange with other process streams or by quenching with hydrogen. Other hydrocracking conditions include a pressure of 35 to 700 atmospheres of hydrogen partial pressure, preferably 70 atmospheres to 210 atmospheres and more preferably 100 to 170 atmospheres; a hydrogen rate of 355 to 3550 liters per liter of slurry, preferably 380 to 1780 liters of hydrogen per liter of slurry; and a slurry liquid hourly space velocity in the range 0.1 to 2/hr., preferably 0.2 to 0.5/hr.

Preferably the pressure in the stabilizer and the catalytic hydrocracking stage are substantially the same to eliminate interstage pumping.

Preferably the entire effluent from the dissolver is passed through the stabilizer to the hydrocracking zone. However, since small quantities of water and light gases ($C_1$-$C_4$) are produced in the dissolver stage by hydrogenation of the coal liquids, the catalyst in the hydrocracking zone is subjected to a lower hydrogen partial pressure than if these materials were absent. Since higher hydrogen partial pressures tend to increase catalyst life, it may be preferable in a commercial operation to remove a portion of the water and light gases before the stream enters the hydrocracking stage. Furthermore, interstage removal of the carbon monoxide and other oxygen-containing gases may reduce hydrogen consumption in the hydrocracking stage.

The effluent 130 from reaction zone 120 is preferably separated into a gaseous fraction 150 and a solids-lean fraction 160 in zone 140. The gaseous fraction comprises light oils boiling below about 200° C. and normally gaseous components such as $H_2$, CO, $CO_2$, $H_2O$ and the $C_1$-$C_4$ hydrocarbons. Preferably the $H_2$ is separated from the other gaseous components and recycled to the hydrocracking or dissolving stages (not shown).

The liquid-solids fraction 160 is fed to separation zone 170 wherein the stream is further separated into a rich hydrogen-donor solvent, solids-lean stream 70 and solids-rich stream 180. Insoluble solids are separated in zone 170 by conventional methods, for example, hydrocloning, filtering, centrifuging and gravity settling or any combination of said methods. Preferably, the insoluble solids are separated by gravity settling, which is a particularly added advantage of the present invention, since the effluent from the hydrocracking reaction zone has a low viscosity and a relatively low specific gravity of less than one. The low gravity of the effluent allows rapid separation of the solids by gravity settling such that generally 90 weight percent of the solids can be rapidly separated. Actual testing indicates that solid contents as low as 0.1 weight percent may be achieved with gravity settlers. Preferably, the insoluble solids are removed by gravity settling at an elevated temperature in the range 150° C. to 205° C. and at a pressure in the range 1 atmosphere to 340 atmospheres, preferably 1 atmosphere to 70 atmospheres. Separation of the solids at an elevated temperature and pressure is particularly desirable to minimize liquid viscosity and density and to prevent bubbling. The solids-lean rich hydrogen-donor solvent stream is recycled via line 70 for blending with the dissolver effluent 60.

The solids-rich product may then be passed to other separation zones (not shown) via line 75. These zones may include distilling, fluid coking, delayed coking, centrifuging, hydrocloning, filtering, gravity settling or any combination of the above methods. The liquid product, after conventional clean-up techniques, is essentially solids-free and contains less than one weight percent solids.

The process of the present invention produces extremely clean, normally liquid products. The normally liquid products, that is, all of the product fractions boiling above $C_4$, have an unusually low specific gravity; a low sulfur content of less than 0.1 weight percent, generally less than 0.2 weight percent and a low nitrogen content of less than 0.5 weight percent, generally less than 0.2 weight percent.

As is readily apparent from the foregoing, the process of the present invention is simple and produces normally liquid products from coal which are useful for many purposes. The broad range product is particularly useful as a turbine fuel, while particular fractions are useful for gasoline, jet and other fuels.

What is claimed is:

1. A three-stage process for liquefying coal which comprises:

forming a coal-solvent slurry by mixing subdivided coal with a lean hydrogen-donor solvent;

passing said slurry through a dissolving stage at a temperature in the range of 400°-480° C. and at a slurry hourly space velocity in the range of 2–150 hr.$^{-1}$ to substantially dissolve said coal;

passing effluent from said dissolving stage with a rich hydrogen-donor solvent through a stabilization stage at a temperature in the range of 400°–440° C. and at a liquid space velocity in the range of 1–12 hr.$^{-1}$ to partially hydrogenate the dissolved coal;

separating a portion of the effluent from said stabilization stage for use as lean hydrogen-donor solvent;

passing the remainder of said effluent from said stabilization stage through a catalytic reaction stage containing hydrocracking catalyst and operating under hydrocracking conditions including a hydrogen partial pressure in the range of 35–700 atmospheres and at a temperature in the range of 345°–425° C.; and separating a portion of the effluent from said catalytic reaction zone for use as a rich hydrogen-donor solvent.

2. A process as recited in claim 1, wherein said dissolving and stabilization stages are free of externally-supplied catalyst and contact particles.

3. A process as recited in claim 2, further comprising removing at least a portion of the coal residue from said lean hydrogen-donor solvent before mixing the lean solvent with the subdivided coal.

4. A process as recited in claim 3, further comprising removing at least a portion of the coal residue from the portion of the catalytic reaction stage effluent used as rich hydrogen-donor solvent before passing the same through said stabilization stage.

5. A process as recited in claim 4, further comprising adding hydrogen to said stabilization stage to maintain the hydrogen partial pressure in the range of 70 to 700 atmospheres.

6. A process as recited in claim 3, claim 4 or claim 5, wherein the slurry space velocity in said dissolving stage is in the range 12–120 hr.$^{-1}$.

7. A process as recited in claim 1 wherein said dissolving stage is operated without added molecular hydrogen.

8. A process as recited in claim 1 wherein said stabilization stage is operated at a temperature lower than the temperature of said dissolving stage.

9. A process as recited in claim 1 wherein said catalytic reaction stage is operated at a temperature lower than the temperature of said stabilization stage.

10. A process as recited in claim 1 wherein said stabilization stage is operated at a temperature lower than the temperature of said dissolver stage and said catalytic reaction stage is operated at a temperature lower than the temperature of said stabilization stage.

* * * * *